US012453904B2

(12) United States Patent
Lin

(10) Patent No.: US 12,453,904 B2
(45) Date of Patent: Oct. 28, 2025

(54) SUBMERSIBLE PROPELLER

(71) Applicant: Qun Lin, Shanghai (CN)

(72) Inventor: Qun Lin, Shanghai (CN)

( * ) Notice: Subject to any disclaimer, the term of this patent is extended or adjusted under 35 U.S.C. 154(b) by 399 days.

(21) Appl. No.: 17/792,136

(22) PCT Filed: Jun. 23, 2020

(86) PCT No.: PCT/CN2020/097595
§ 371 (c)(1),
(2) Date: Jul. 11, 2022

(87) PCT Pub. No.: WO2021/253466
PCT Pub. Date: Dec. 23, 2021

(65) Prior Publication Data

US 2023/0191203 A1 Jun. 22, 2023

(30) Foreign Application Priority Data

Jun. 18, 2020 (CN) ..... 202010562344.7

(51) Int. Cl.
*A63B 35/12* (2006.01)

(52) U.S. Cl.
CPC ..... *A63B 35/12* (2013.01); *A63B 2220/805* (2013.01)

(58) Field of Classification Search
CPC ..... A63B 35/00; A63B 35/08; A63B 35/10; A63B 35/12; A63B 2220/24; A63B 2220/73; A63B 2220/80; A63B 24/0003
(Continued)

(56) References Cited

U.S. PATENT DOCUMENTS 3,635,188 A * 1/1972 Rutkowski ..... A63B 35/12 440/6
6,823,813 B2 * 11/2004 Mazin ..... B63C 11/46 440/6

(Continued)

FOREIGN PATENT DOCUMENTS

CN 107176278 A 9/2017
CN 207173925 A 4/2018

(Continued)

OTHER PUBLICATIONS

Taiwanese Office Action corresponding to Taiwanese Application No. 110122484 containing TW search report listing of references, dated Mar. 8, 2022, 4 pages.

(Continued)

*Primary Examiner* — Daniel V Venne
(74) *Attorney, Agent, or Firm* — Reising Ethington P.C.

(57) ABSTRACT

A submersible propeller that includes a battery and propellers in which: the propellers include a left propeller and a right propeller; front portions of the left propeller and the right propeller are connected to a waist-wearing power supply battery through a power supply cable for the left propeller and a power supply cable for the right propeller respectively. Rear portions of the left propeller and the right propeller are connected to a left angle controller and a right angle controller through a connection cable for the left angle controller and a connection cable for the right angle controller respectively. The left propeller and the left angle controller are symmetrically distributed left-and-right with respect to the right propeller and the right angle controller. By using angle controllers on the legs, various modes such as advancing, variable-speed advancing, retreating, turning, and in-situ spinning can be implemented.

14 Claims, 6 Drawing Sheets

(58) Field of Classification Search
USPC ..... 441/60; 440/6; 114/315
See application file for complete search history.

(56) References Cited

U.S. PATENT DOCUMENTS

| | | | |
|---|---|---|---|
| 7,328,669 | B2 | 2/2008 | Adams |
| 7,740,418 | B2 | 6/2010 | Adams |
| 8,567,336 | B1 | 10/2013 | Mazin |
| 9,321,512 | B1 | 4/2016 | Mazin |
| 9,878,211 | B1 | 1/2018 | Knowles |
| 10,398,940 | B2 | 9/2019 | Grosse Austing |
| 2003/0045182 | A1 | 3/2003 | Frasier |
| 2006/0081168 | A1 | 4/2006 | Adams |
| 2009/0044742 | A1 | 2/2009 | Adams |
| 2019/0091516 | A1 | 3/2019 | Grosse Austing |

FOREIGN PATENT DOCUMENTS

| | | | |
|---|---|---|---|
| CN | 108482617 | A | 9/2018 |
| CN | 208760874 | U | 4/2019 |
| CN | 209479931 | U | 10/2019 |
| CN | 110826405 | A | 2/2020 |
| CN | 212395776 | U | 1/2021 |
| FR | 2763512 | A1 | 11/1998 |
| JP | 2008161341 | A | 7/2008 |
| WO | 2017157887 | A1 | 9/2017 |
| WO | 2017157889 | A1 | 9/2017 |
| WO | 2019088641 | A1 | 5/2019 |
| WO | 2020067888 | A1 | 4/2020 |

OTHER PUBLICATIONS

International Search Report translation into English for corresponding to International Application No. PCT/CN2020/097595, dated Mar. 4, 2021, 3 pages.

Written Opinion corresponding to International Application No. PCT/CN2020/097595, dated Mar. 17, 2021, 3 pages.

European Search Report corresponding to application EP20941230.3, dated Nov. 28, 2023, 6 pages.

* cited by examiner

SUBMERSIBLE PROPELLER

TECHNICAL FIELD

The present disclosure relates to the technical field of propellers; in particular, the present disclosure relates to a submersible propeller.

BACKGROUND

Diving sport has become more and more popular, and various underwater propellers are often seen in diving equipment, but these propellers are usually of a hand-held or backpack type. Regardless of the method used, control systems of these propellers all require a diver to control a propulsion state directly by hand or through a connected controller, so the diver cannot free up hands to operate other equipment. The fixed backpack type will also cause conflicts with other equipment such as a gas cylinder; many underwater propellers only have a simple propulsion function, and cannot implement operations such as retreating and spinning.

SUMMARY

In order to overcome the shortcomings of the prior art, the present disclosure provides a submersible propeller. By using angle controllers on the legs, various modes such as advancing, variable-speed advancing, retreating, turning, and in-situ spinning can be implemented. The entire operation process only relies on adjustment of an included angle between the thigh and the calf by the diver, and a control by hand is not required at all.

In order to achieve the above object, a submersible propeller including a battery and propellers is designed, in which: the propellers include a left propeller and a right propeller; front portions of the left propeller and the right propeller are connected to a waist-wearing power supply battery through a power supply cable for the left propeller and a power supply cable for the right propeller respectively; rear portions of the left propeller and the right propeller are connected to a left angle controller and a right angle controller through a connection cable for the left angle controller and a connection cable for the right angle controller respectively; and the left propeller and the left angle controller are symmetrically distributed left-and-right with respect to the right propeller and the right angle controller.

The structure of the left angle controller is consistent with that of the right angle controller; the left angle controller includes an inner disc and an outer disc, and middle portions of the inner disc and the outer disc are connected by a rotating shaft and bolt; one side of the inner disc is connected to one end of a control rod of the inner disc, the other end of the control rod of the inner disc is connected to one end of a curved arm of the inner disc, and the inner disc, the control rod of the inner disc and the curved arm of the inner disc are of an integral structure; one side of the outer disc is connected to one end of a control rod of the outer disc, the other end of the control rod of the outer disc is connected to one end of a curved arm of the outer disc, and the outer disc, the control rod of the outer disc and the curved arm of the outer disc are of an integral structure.

The inner disc is provided therein with a circular groove, and a central hole of the inner disc is provided at a center of a bottom of the circular groove; a first groove is provided at an outer edge 90° clockwise with the central hole of the inner disc serving as the center, and the first groove is a circular groove; a second groove is provided at an outer edge 90°~135° clockwise with the central hole of the inner disc serving as the center, and the second groove is a long strip-shaped groove; a third groove is provided at an outer edge 135°~180° clockwise with the central hole of the inner disc serving as the center, and the third groove is composed of a plurality of circular grooves; and the first groove, the second groove and the third groove are respectively provided therein with photoelectric sensors.

A central part of the outer disc is provided with a disc-shaped boss, and a central hole of the outer disc is provided at a center of the disc-shaped boss; a fourth groove is provided at an outer edge 180° clockwise with the central hole of the outer disc serving as the center, and the fourth groove is a circular groove in which an LED is arranged.

The other ends of the curved arm of the inner disc and the curved arm of the outer disc are respectively provided with a strap fixing hole.

The left propeller is bound to the root of the left thigh through a fixing strap for the left propeller, and the right propeller is bound to the root of the right thigh through a fixing strap for the right propeller.

The curved arm of the inner disc and the curved arm of the outer disc at the front and rear of the left angle controller and the right angle controller are respectively bound to the thigh and the calf through fixing straps for the angle controllers.

The waist-wearing power supply battery is provided with a power control switch, the waist-wearing power supply battery is connected to the left propeller and the right propeller respectively through a diving depth detector, and the left propeller and the right propeller are connected to the left angle controller and the right angle controller respectively through relay control boxes respectively; the left angle controller and the right angle controller are internally provided with a light source controller respectively.

A control method for a submersible propeller is also provided, which specifically includes:

(1) binding a waist-wearing power supply battery to the waist; wherein a left propeller and a right propeller are bound to the root of the left thigh and the root of the right thigh respectively; front and rear portions of a left angle controller are bound to the left thigh and the left calf respectively; and front and rear portions of a right angle controller are bound to the right thigh and the right calf respectively;

(2) turning on a power control switch on the waist-wearing power supply battery when entering into underwater diving;

(3) controlling the left propeller and the right propeller to be in a retreating state when the thighs and calves on the left and right sides are bent at the same time to form an angle of 90°, at which time LEDs in the left angle controller and the right angle controller are located in first grooves;

(4) controlling the left propeller and the right propeller to be in a static state when the thighs and calves on the left and right sides are bent at the same time to form an angle of 90°~135°, at which time the LEDs in the left angle controller and the right angle controller are located in second grooves;

(5) controlling the left propeller and the right propeller to be in a variable-speed advancing state when the thighs and calves on the left and right sides are bent at the same time to form an angle of 135°~180°, at which time the LEDs in the left angle controller and the right angle controller are located in third grooves; wherein the larger the angle, the faster the advancing speed;

(6) controlling the left propeller and the right propeller to be in a turning-left state when the left thigh and calf bend to form an angle of 90°~135° and the right thigh and calf bend to form an angle of 135°~180°;

(7) controlling the left propeller and the right propeller to be in a turning-right state when the right thigh and calf bend to form an angle of 90°~135° and the left thigh and calf bend to form an angle of 135°~180°;

(8) controlling the left propeller and the right propeller to be in an in-situ spinning state when the thigh and calf on one side bend to form an angle of 90° and the thigh and calf on the other side bend to form an angle of 135°~180°; and (9) turning off the power control switch on the waist-wearing power supply battery when diving is finished after coming out of the water.

As compared with the prior art, the present disclosure provides a submersible propeller in which by using angle controllers on the legs, various modes such as advancing, variable-speed advancing, retreating, turning, and in-situ spinning can be implemented. The entire operation process only relies on adjustment of an included angle between the thigh and the calf by the diver, and a control by hand is not required at all.

Figure 1:
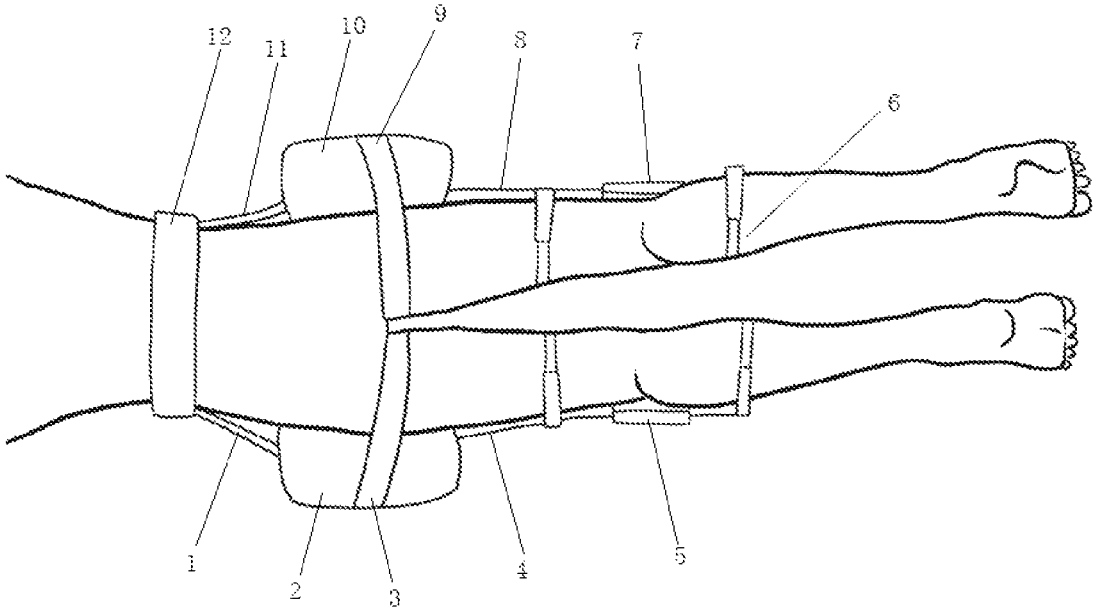
FIG. 1 is a top view of the present disclosure in a state of being installed on the body of a diver.
Figure 2:
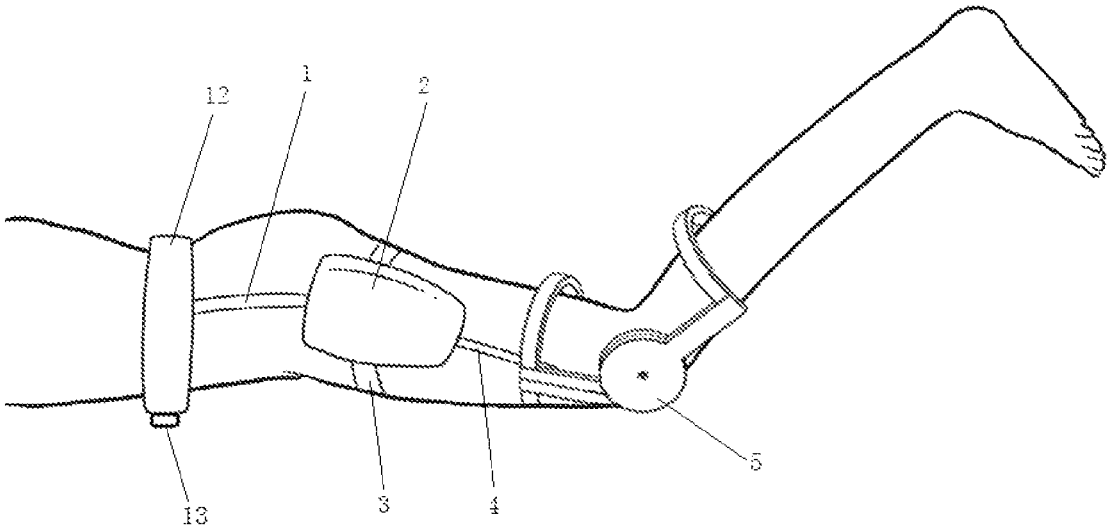
FIG. 2 is a side view of the present disclosure in a state of being installed on the body of the diver.
Figure 3:
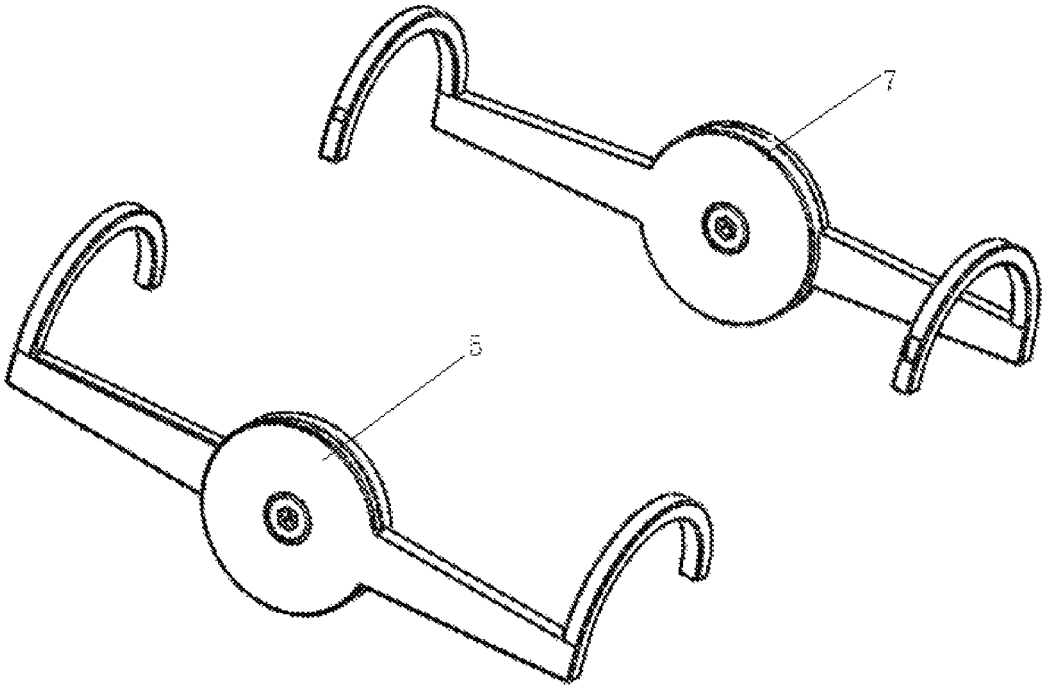
FIG. 3 is a schematic view showing a distribution state of a left angle controller and a right angle controller.
Figure 4:
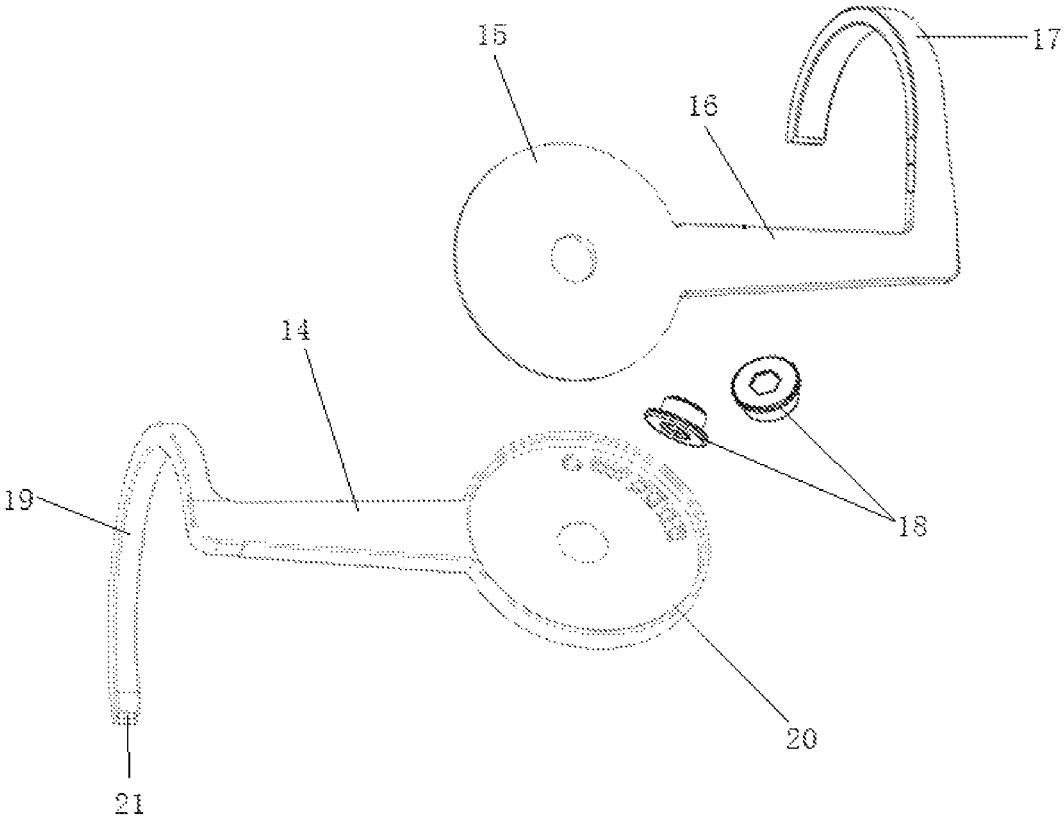
FIG. 4 is a schematic structural view of the left angle controller.
Figure 5:
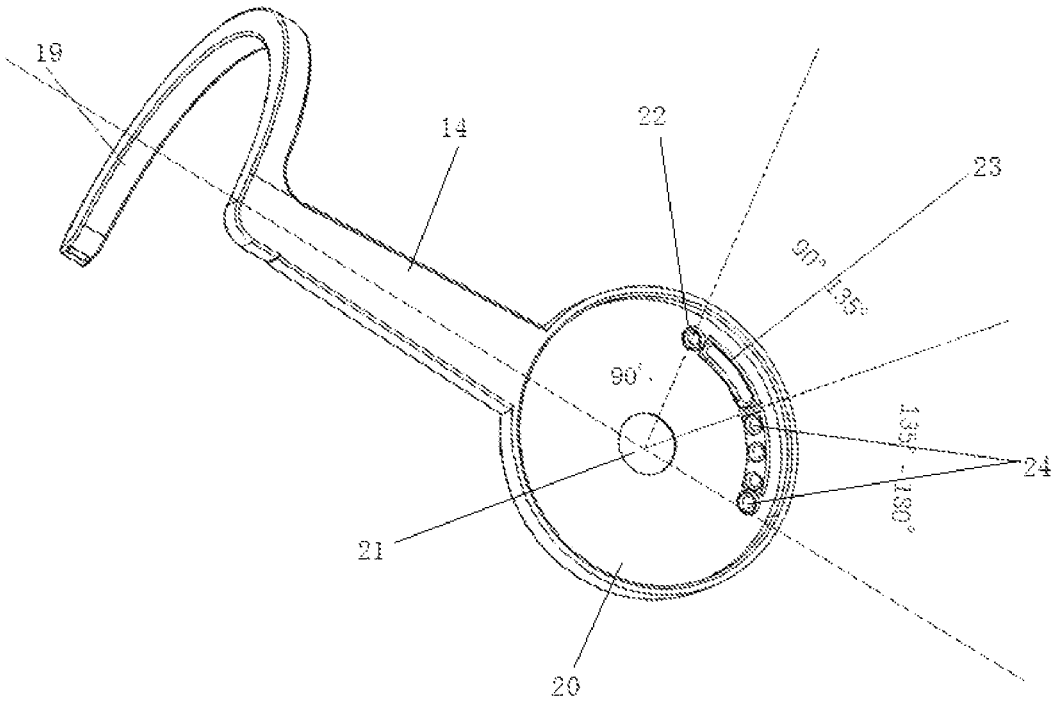
FIG. 5 is a schematic structural view of an inner disc in FIG. 4.
Figure 6:
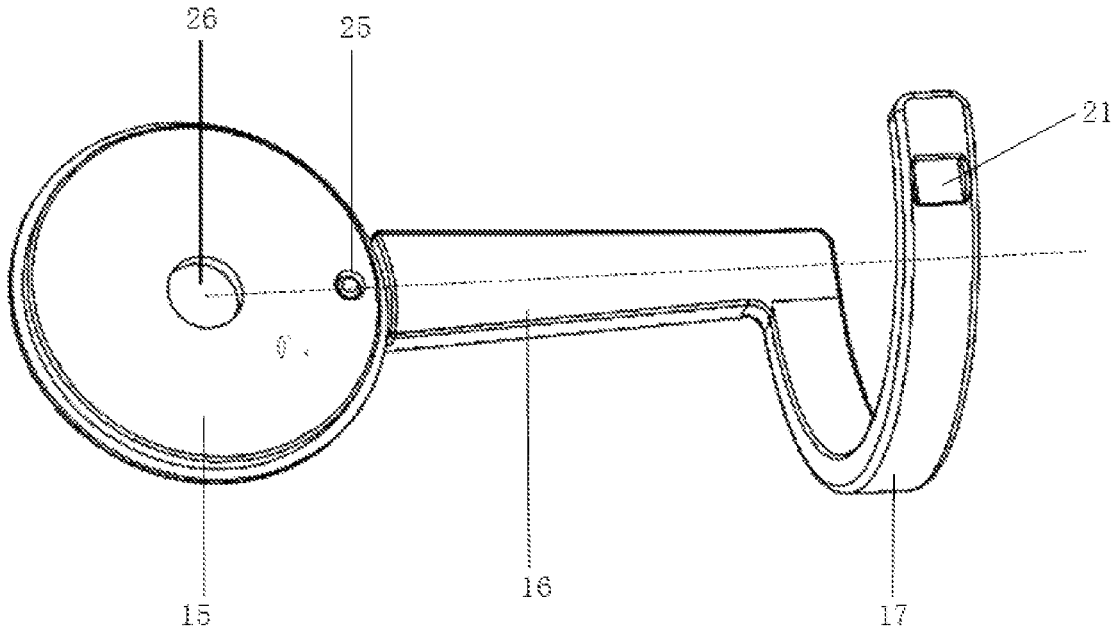
FIG. 6 is a schematic structural view of an outer disc in FIG. 4.

List of reference signs in FIGS. 1 to 7: 1: power supply cable for left propeller; 2: left propeller; 3: fixing strap for left propeller; 4: connection cable for left angle controller; 5: left angle controller; 6: fixing strap for angle controller; 7: right angle controller; 8: connection cable for right angle controller; 9: fixing strap for right propeller; 10: right propeller; 11: power supply cable for right propeller; 12: waist-wearing power supply battery; 13: power control switch; 14: control rod of inner disc; 15: outer disc; 16: control rod of outer disc; 17: curved arm of outer disc; 18: rotating shaft and bolt; 19: curved arm of inner disc; 20: inner disc; 21: strap fixing hole; 22: first groove; 23: second groove; 24: third groove; 25: fourth groove; 26: central hole of outer disc; 27: relay control box; 28: diving depth detector; 29: light source controller.

DETAILED DESCRIPTION

Hereinafter, the present disclosure will be further explained with reference to the drawings.

As shown in FIGS. 1 to 7, the propellers includes a left propeller 2 and a right propeller 10; front portions of the left propeller 2 and the right propeller 10 are connected to a waist-wearing power supply battery 12 through a power supply cable 1 for the left propeller and a power supply cable 11 for the right propeller respectively; rear portions of the left propeller 2 and the right propeller 10 are connected to a left angle controller 5 and a right angle controller 7 through a connection cable 4 for the left angle controller and a connection cable 8 for the right angle controller respectively; and the left propeller 2 and the left angle controller 5 are symmetrically distributed left-and-right with respect to the right propeller 5 and the right angle controller 10.

The structure of the left angle controller 5 is consistent with that of the right angle controller 7; the left angle controller 5 includes an inner disc and an outer disc, and middle portions of the inner disc 20 and the outer disc 15 are connected by a rotating shaft and bolt 18; one side of the inner disc 20 is connected to one end of a control rod 14 of the inner disc, the other end of the control rod 14 of the inner disc is connected to one end of a curved arm 19 of the inner disc, and the inner disc 20, the control rod 14 of the inner disc and the curved arm 19 of the inner disc are of an integral structure; one side of the outer disc 15 is connected to one end of a control rod 16 of the outer disc, the other end of the control rod 16 of the outer disc is connected to one end of a curved arm 17 of the outer disc, and the outer disc 15, the control rod 16 of the outer disc and the curved arm 17 of the outer disc are of an integral structure.

The inner disc 20 is provided therein with a circular groove, and a central hole 21 of the inner disc is provided at a center of a bottom of the circular groove; a first groove 22 is provided at an outer edge 90° clockwise with the central hole 21 of the inner disc serving as the center, and the first groove 22 is a circular groove; a second groove 23 is provided at an outer edge 90°~135° clockwise with the central hole 21 of the inner disc serving as the center, and the second groove 23 is a long strip-shaped groove; a third groove 24 is provided at an outer edge 135°~180° clockwise with the central hole 21 of the inner disc serving as the center, and the third groove 24 is composed of a plurality of circular grooves; and the first groove 22, the second groove 23 and the third groove 24 are respectively provided therein with photoelectric sensors.

Windows of all these grooves are sealed with transparent materials, and the photoelectric sensors and circuits inside the entire inner disc are all independently sealed and can be separately waterproof.

A central part of the outer disc 15 is provided with a disc-shaped boss, and a central hole 26 of the outer disc is provided at a center of the disc-shaped boss; a fourth groove 25 is provided at an outer edge 180° clockwise with the central hole 26 of the outer disc serving as the center, and the fourth groove 25 is a circular groove in which an LED is arranged.

A window of the fourth groove 25 is also sealed with a transparent material, a power supply battery of the LED is installed in an interlayer of the outer disc 15, and the entire outer disc 15 is independently sealed and can be separately waterproof.

The other ends of the curved arm 19 of the inner disc and the curved arm 17 of the outer disc are respectively provided with a strap fixing hole 21.

The inner disc 20 and the outer disc 15 are in a state before assembly. The inner and outer discs are assembled together through the inner and outer central holes and the shaft and bolt 18. After the assembly, it is ensured that the inner and outer discs can rotate relative to each other; also, with the relative rotation of the inner and outer discs, the LED on the outer disc 15 can respectively align with the positions of several grooves on the inner disc 20 respectively to trigger the photoelectric sensors at different positions in the grooves of the inner disc to be in a working or closed state, thereby controlling an operating state of the propeller.

The left propeller 2 is bound to the root of the left thigh through a fixing strap 3 for the left propeller, and the right propeller 10 is bound to the root of the right thigh through a fixing strap 9 for the right propeller.

The curved arm 19 of the inner disc and the curved arm 17 of the outer disc at front and rear of the left angle controller 5 and the right angle controller 7 are respectively bound to the thigh and the calf through fixing straps 6 for the angle controllers.

The waist-wearing power supply battery 12 is provided with a power control switch 13, the waist-wearing power supply battery 12 is connected to the left propeller 2 and the right propeller 10 respectively through a diving depth detector 28, and the left propeller 2 and the right propeller 10 are connected to the left angle controller 5 and the right angle controller 7 through relay control boxes 27 respectively; the left angle controller 5 and the right angle controller 7 are internally provided with a light source controller 29 respectively.

Figure 8:
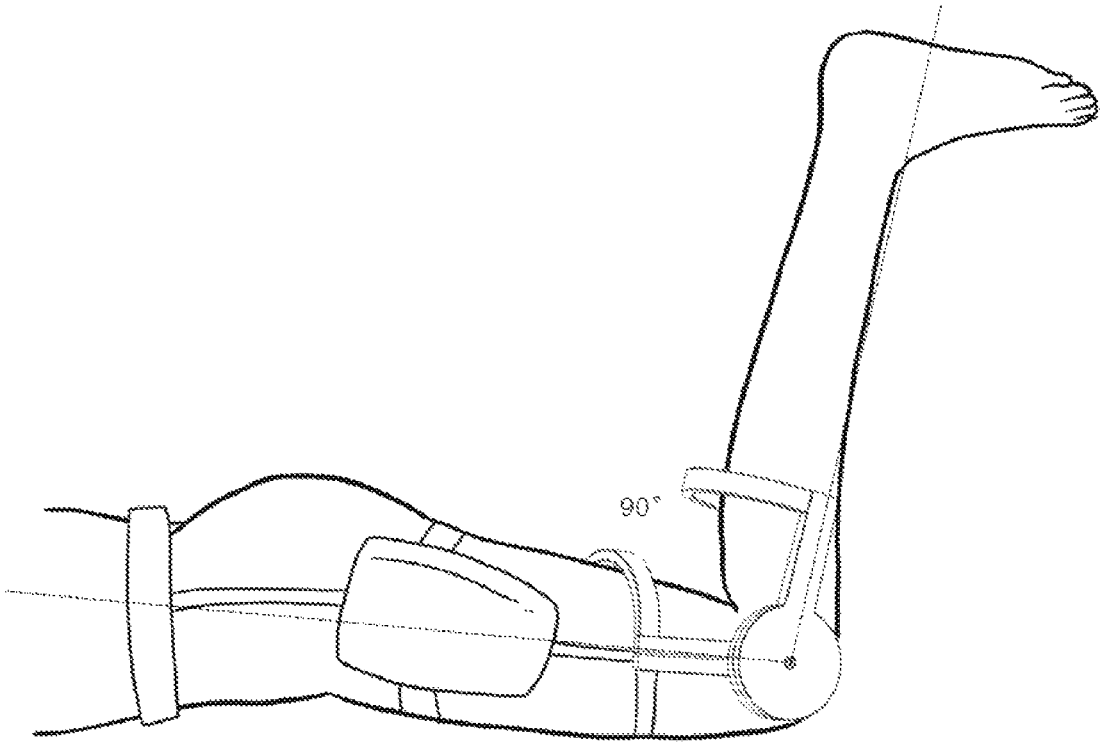
FIGS. 8-12 are schematic views of the present disclosure in the states of retreating, standing still, variable-speed advancing, turning, and in-situ spinning.
Figure 9:
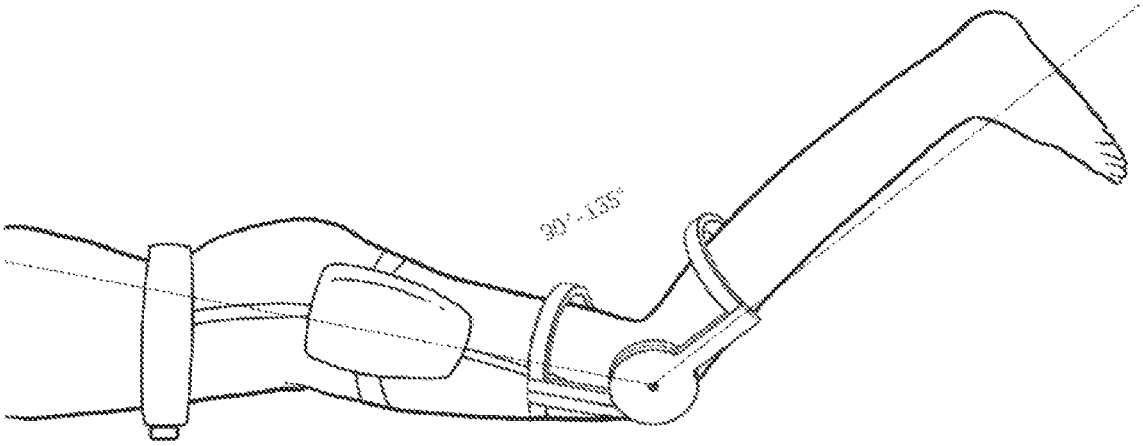
Figure 10:
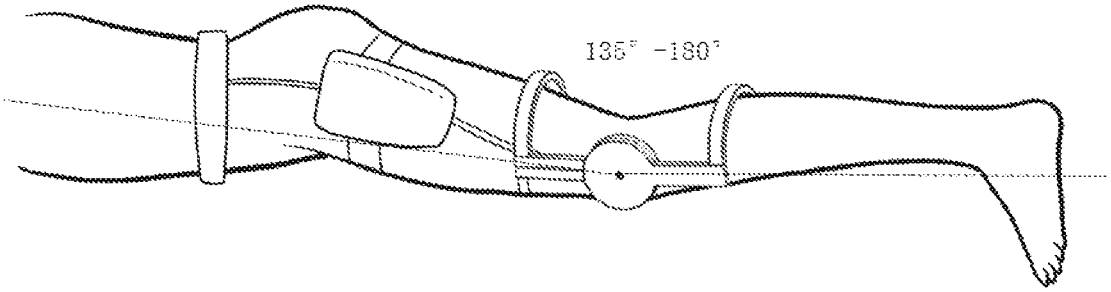
Figure 11:
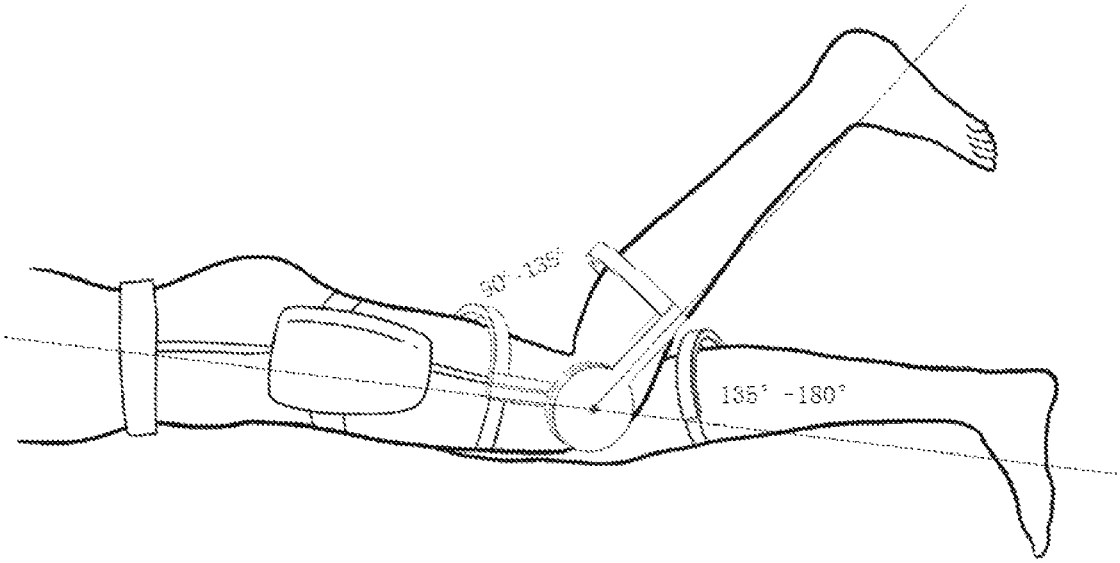
Figure 12:
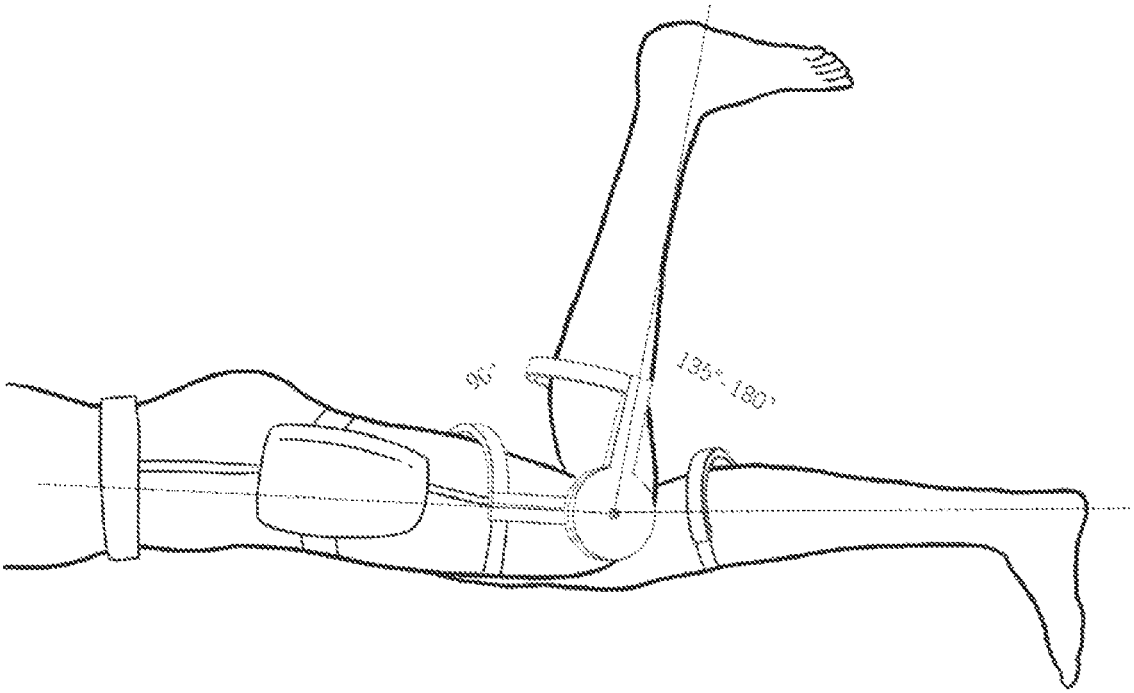

A control method for a submersible propeller is also provided, which specifically includes:

(1) binding a waist-wearing power supply battery to the waist; in which a left propeller and a right propeller are bound to the root of the left thigh and the root of the right thigh respectively; front and rear portions of a left angle controller are bound to the left thigh and the left calf respectively; and front and rear portions of a right angle controller are bound to the right thigh and the right calf respectively;

(2) turning on a power control switch on the waist-wearing power supply battery when entering into underwater diving;

(3) controlling the left propeller and the right propeller to be in a retreating state when the thighs and calves on the left and right sides are bent at the same time to form an angle of 90°, at which time LEDs in the left angle controller and the right angle controller are located in first grooves, as shown in FIG. 8;

(4) controlling the left propeller and the right propeller to be in a static state when the thighs and calves on the left and right sides are bent at the same time to form an angle of 90°~135°, at which time the LEDs in the left angle controller and the right angle controller are located in second grooves, as shown in FIG. 9;

(5) controlling the left propeller and the right propeller to be in a variable-speed advancing state when the thighs and calves on the left and right sides are bent at the same time to form an angle of 135°~180°, at which time the LEDs in the left angle controller and the right angle controller are located in third grooves, as shown in FIG. 10; in which the larger the angle, the faster the advancing speed;

(6) controlling the left propeller and the right propeller to be in a turning-left state when the left thigh and calf bend to form an angle of 90°~135° and the right thigh and calf bend to form an angle of 135°~180°, as shown in FIG. 11;

(7) controlling the left propeller and the right propeller to be in a turning-right state when the right thigh and calf bend to form an angle of 90°~135° and the left thigh and calf bend to form an angle of 135°~180°;

(8) controlling the left propeller and the right propeller to be in an in-situ spinning state when the thigh and calf on one side bend to form an angle of 90° and the thigh and calf on the other side bend to form an angle of 135°~180°, as shown in FIG. 12; and (9) turning off the power control switch on the waist-wearing power supply battery when diving is finished after coming out of the water.

The present disclosure utilizes standard diving postures of a diver. The propellers are fixed on both sides of the diver's thighs, the angle controllers are fixed on the knee joints, and there are two control rods and two curved arms connected. The control rods and the curved arms are respectively bound to inner sides of the thighs and calves, the power supply battery is fixed at the waist, and the working state of the propeller is adjusted and controlled by the included angle between the diver's thigh and calf, including advancing, variable-speed advancing, retreating, turning, in-situ spinning, etc. Except for the main power switch, the entire operation process only relies on the diver to adjust the included angle between the thigh and calf, and a control by hand is not required at all; in addition, the present disclosure is also equipped with a diving depth detector to monitor an ascending speed of the diver, and the working state of the propeller can be cut off when the ascending is too fast so that the diver is prevented from rising too fast due to incorrect posture of the diver, or dangers caused by too fast ascending can be avoided.

The present disclosure is divided into left and right parts, which share one waist-wearing power supply battery as the power source. The waist-wearing power supply battery is made into a detachable type so that after the power source is cut off in case of emergency, the waist-wearing power supply battery can be detached and discarded like the diver's weight bag.

The control part of the present disclosure is called angle controller, which is divided into two independent angle controllers on the left and right sides. The angle controller on the left side is driven by the left thigh and calf to control the left propeller, and the angle controller on the right side is driven by the right thigh and calf to control the right propeller; the angle controller is fixed with a control rod and a curved arm. The control rod and the curved arm are respectively fixed on the thigh and calf with straps. When the angle between the thigh and calf changes, the curved arm and the control rod will drive the angle controller to rotate so that the propeller is brought into different working states.

Figure 7:
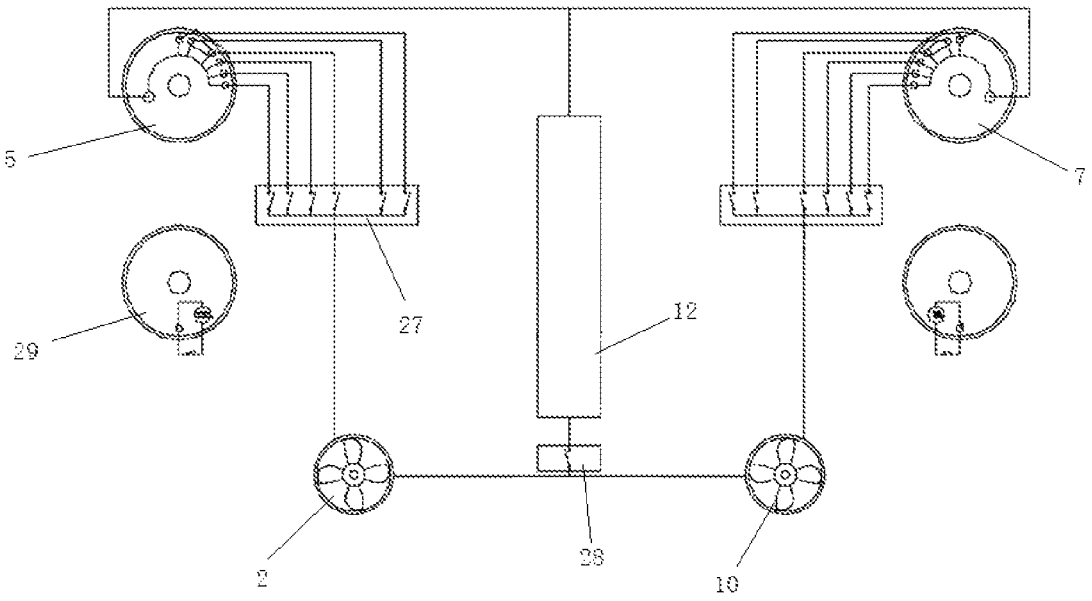
FIG. 7 is a schematic view showing control and connection of the present disclosure.

The cable control of the present disclosure is shown in FIG. 7. In addition to the sharing of one waist-wearing battery for power supply, left and right sets of control circuit systems, which correspond to the two angle controllers installed on the diver's left and right legs respectively, control the two left and right submersible propellers to work respectively. A photoelectric switch circuit at each position is connected to one of the relay control boxes, and the relay control box is connected to the corresponding propeller.

A diving depth detector is installed on the power supply battery line. The ascending speed of the diver will be automatically detected when the present disclosure is working. When the diver has an unbalanced posture, or when the depth detector finds that the ascending speed of the diver is larger than a maximum ascending speed specified by PADI or other diving organizations (for example, 9 m/min) during a normal ascending process, the diving depth detector will automatically turn off the control of the angle controller of the present disclosure over the propeller, so that the propeller stops working, thereby avoiding dangerous situations to the diver caused by the too fast ascending speed due to the influence of the present disclosure.

The working modes of the present disclosure are shown in FIGS. 8, 9, 10 and 11 respectively. The change of the angle between the diver's thigh and calf drives the inner disc and the outer disc of the angle controller to rotate relative to each other so that the working state of the propeller can be controlled and changed; and the change of the angle between the diver's thigh and calf can drive the angle controller to be turned on or off, so that the diver can be in a variety of different diving states.

Retreating state: referring to FIG. 8, when the angle between the diver's thigh and calf is ≤90°, the LED on the outer disc of the angle controller is located at the window position of the photoelectric sensor in the 90° groove of the inner disc, and the propeller is turned on to work in the retreating state; and when the diver's left and right thighs and calves both satisfy this angle, the diver can retreat at a constant speed.

Static state: referring to FIG. 9, when the angles between the diver's left and right thighs and calves are >90°-≤135°, the LEDs on the outer discs of the angle controllers are located at the window positions of the photoelectric sensors in the >90°-≤135° grooves of the inner discs, the operation of the propellers will stop, and the diver is in a static state.

Advancing state: referring to FIG. 10, when the angles between the diver's left and right thighs and calves are >135°-≤180°, the LEDs on the outer discs of the angle controllers are located at the window positions of the photoelectric sensors in the three or four >135°-≤180° grooves; the groove position of a larger angle indicates a higher gear of the propulsion speed. The diver can control the gear of the propulsion speed of the propeller by adjusting the angle between the thigh and calf within this angle range. When the angle reaches or approaches 180°, the advancing speed is maximum.

Turning state: referring to FIG. 11, when the diver needs to turn, he/she only needs to retract the leg in the turning direction so that the angle between the thigh and calf is maintained >90°-≤135°, and the angle between the thigh and calf on the other side is maintained >135°-≤180°, and turning can be implemented under the push of the propeller on one side.

In-situ spinning state: referring to FIG. 12, when the diver needs to spin in-situ, he/she only needs to make the angle between the thigh and calf on one side ≤90° (the propeller on this side is in the retreating state), and make the angle between the thigh and calf on the other side >135°-≤180° (the propeller on this side is in the advancing state), so that in-situ spinning of the diver can be realized.

What is claimed is:

1. A submersible propeller, comprising a battery and propellers, wherein the propellers comprise a left propeller and a right propeller; front portions of the left propeller and the right propeller are electrically connected to the battery through a power supply cable for the left propeller and a power supply cable for the right propeller respectively; rear portions of the left propeller and the right propeller are connected to a left angle controller and a right angle controller through a connection cable for the left angle controller and a connection cable for the right angle controller respectively; wherein the left angle controller and the right angle controller are configured to sense an included angle formed between a thigh and calf of a diver at the diver's left-side and right-side respectively, and are configured to adjust and control a working state of the propellers based on the included angle.

2. The submersible propeller according to claim 1, wherein the left angle controller comprises an inner disc and an outer disc, and middle portions of the inner disc and the outer disc are connected by a rotating shaft and a bolt; one side of the inner disc is connected to one end of a control rod of the inner disc, one side of the outer disc is connected to one end of a control rod of the outer disc, wherein a plurality of photoelectric sensors are arranged along a peripheral edge of the inner disc and an LED is arranged along a peripheral edge of the outer disc.

3. The submersible propeller according to claim 1, wherein the battery is a waist-wearing power supply battery and provided with a power control switch, the waist-wearing power supply battery is connected to the left propeller and the right propeller respectively through a diving depth detector, and the left propeller and the right propeller are connected to the left angle controller and the right angle controller respectively through relay control boxes respectively; the left angle controller and the right angle controller are internally provided with a light source controller respectively.

4. The submersible propeller according to claim 1, wherein the working state of the propeller includes one or more of advancing, variable-speed advancing, retreating, turning-left, turning-right and in-situ spinning.

5. The submersible propeller according to claim 4, wherein the working state of the propellers includes:

controlling the left propeller and the right propeller to operate in a retreating state when both the thigh and calve of the driver at the driver's left-side and right-side are bent simultaneously to form an angle of 90°;

controlling the left propeller and the right propeller to remain static when both the thigh and calve of the driver at the driver's left-side and right-side are bent simultaneously to form an angle of 90°~135°;

controlling the left propeller and the right propeller to operate in a variable-speed advancing state when both the thigh and calve of the driver at the driver's left-side and right-side are bent simultaneously to form an angle of 135°~180°, and wherein a larger angle corresponds a faster advancing speed;

controlling the left propeller and the right propeller to turn left when a left thigh and calf bend to form an angle of 90°~135° and a right thigh and calf bend to form an angle of 135° ~180°;

controlling the left propeller and the right propeller to turn right when a right thigh and calf bend to form an angle of 90°~135° and a left thigh and calf bend to form an angle of 135°~180°; and controlling the left propeller and the right propeller to spin in place when the thigh and calf on one side bend to form an angle of 90° and the thigh and calf on the other side bend to form an angle of 135°~180°.

6. The submersible propeller according to claim 1, wherein the left propeller and the left angle controller are symmetrically distributed left-and-right with respect to the right propeller and the right angle controller, wherein a structure of the left angle controller is consistent with the corresponding structure of the right angle controller.

7. The submersible propeller according to claim 2, wherein the inner disc is provided therein with a circular groove, and a central hole of the inner disc is provided at a center of a bottom of the circular groove; a first groove is provided at an outer edge 90° clockwise from the central hole of the inner disc; a second groove is provided at an outer edge 90°~135° clockwise from the central hole of the inner disc; a third groove is provided at an outer edge 135°~180° clockwise from the central hole of the inner disc; and the first groove, the second groove and the third groove are respectively provided therein with the photoelectric sensors, wherein the first groove is a circular groove, the second groove is an elongated groove and the third groove is composed of a plurality of circular grooves; a central part of the outer disc is provided with a disc-shaped boss, and a central hole of the outer disc is provided at a center of the disc-shaped boss; a fourth groove is provided at an outer edge 180° clockwise from the central hole of the outer disc, and the fourth groove is a circular groove and accommodating the LED.

8. The submersible propeller according to claim 2, wherein the other end of the control rod of the inner disc is connected to one end of a curved arm of the inner disc; the other end of the control rod of the outer disc is connected to one end of a curved arm of the outer disc, wherein the other ends of the curved arm of the inner disc and the curved arm of the outer disc are respectively provided with a strap fixing hole and connected to fixing straps for the angle controllers, wherein the left propeller is bound to a root of the driver's left thigh through a fixing strap for the left propeller, and the right propeller is bound to a root of the driver's right thigh through a fixing strap for the right propeller.

9. An angle controller for a submersible propeller, wherein the angle controller comprises an inner disc and an outer disc, and middle portions of the inner disc and the outer disc are connected by a rotating shaft and bolt; one side of the inner disc is connected to one end of a control rod of the inner disc, one side of the outer disc is connected to one end of a control rod of the outer disc wherein a plurality of photoelectric sensors are arranged along a peripheral edge of the inner disc and an LED is arranged along a peripheral edge of the outer disc.

10. The angle controller according to claim 9, wherein the other end of the control rod of the inner disc is connected to one end of a curved arm of the inner disc; the other end of the control rod of the outer disc is connected to one end of a curved arm of the outer disc, wherein the other ends of the curved arm of the inner disc and the curved arm of the outer disc are respectively provided with a strap fixing hole configured to be connected to fixing straps for the angle controllers.

11. The angle controller according to claim 9, wherein the inner disc is provided therein with a circular groove, and a central hole of the inner disc is provided at a center of a bottom of the circular groove; a first groove is provided at an outer edge 90° clockwise from the central hole of the inner disc; a second groove is provided at an outer edge 90°~135° clockwise from the central hole of the inner disc; a third groove is provided at an outer edge 135°~180° clockwise from the central hole of the inner disc; and the first groove, the second groove and the third groove are respectively provided with the photoelectric sensors.

12. The angle controller according to claim 11, wherein the first groove is a circular groove, the second groove is an elongated groove and the third groove is composed of a plurality of circular grooves.

13. The angle controller according to claim 9, wherein a central part of the outer disc is provided with a disc-shaped boss, and a central hole of the outer disc is provided at a center of the disc-shaped boss; a fourth groove is provided at an outer edge 180° clockwise from the central hole of the outer disc, and the fourth groove is a circular groove in which the LED is arranged.

14. The angle controller according to claim 9, wherein the inner disc, the control rod of the inner disc and the curved arm of the inner disc are integrally formed, and the outer disc, the control rod of the outer disc and the curved arm of the outer disc are integrally formed.

* * * * *